United States Patent [19]

Bryant

[11] Patent Number: 4,881,378

[45] Date of Patent: Nov. 21, 1989

[54] HIGH SPEED ICEMAKER

[76] Inventor: Jimmy L. Bryant, 4832 Linden St., Columbia, S.C. 29203

[21] Appl. No.: 193,792

[22] Filed: May 13, 1988

[51] Int. Cl.[4] ..... F25C 1/00

[52] U.S. Cl. ..... 62/348; 62/344

[58] Field of Search ..... 62/348, 344

[56] References Cited

U.S. PATENT DOCUMENTS

| | | | |
|---|---|---|---|
| 1,966,150 | 7/1934 | Tamm | 62/348 X |
| 2,586,588 | 2/1952 | Weseman et al. | 62/348 |
| 2,866,322 | 12/1958 | Muffly | 62/348 X |
| 3,289,430 | 12/1966 | Dedricks et al. | 62/348 X |
| 3,812,686 | 5/1974 | Tester | 62/348 X |
| 4,300,359 | 11/1981 | Koeneman et al. | 62/344 X |
| 4,338,794 | 7/1982 | Haasis, Jr. | 62/348 |

*Primary Examiner*—William E. Tapolcai

*Attorney, Agent, or Firm*—Benoni O. Reynolds

[57] ABSTRACT

Apparatus for reducing the temperature of tap water enroute to the ice making section of a commercial ice cube maker. Precooling is accomplished by coiled tubing immersed in residual ice water recovered from the interior of the storage bin by a reservoir mounted beneath the drain of the storage bin of the commercial ice cube maker. Additional cooling of held water is accomplished by coiled tubing inserted in the flow line and located on the floor of the storage bin beneath the stored ice cubes. In both cases, the cooling energy which would otherwise be wasted is utilized to remove BTU's of heat from the tap water prior to injection of the tap water into the ice cube making section of the commercial ice cube maker. Requiring no additional energy to operate, the apparatus dramatically increases the production and efficiency of the commercial ice cube maker, especially in warmer climates.

2 Claims, 2 Drawing Sheets

HIGH SPEED ICEMAKER

BACKGROUND OF THE INVENTION (1) Field of Invention

This invention relates to apparatus for ice making and is especially suited for easy installation at the factory or on site as an improvement for commercial ice cube makers.

(2) Description of Prior Art

Conventional commercial ice cube makers consume a great deal of electrical energy as the compressors process the ambient temperature tap water to near freezing temperature and distribute it over the head of the ice making section to form ice cubes. Many of the prior art attempts to speed up the process have introduced additional complex equipment which in themselves have consumed further energy rather than saving it. The present invention solves this problem by speeding up the ice making process, thus increasing its productivity and efficiency, at a savings in energy rather than consuming additional energy.

Illustrative of early ice making machines is that of Church (1894), U.S. Pat. No. 529,345. His machine had a horizontal supporting bed, with water confining sides and means for applying a freezing agent to the bottom only of the bed. Controlling the speed of the freezing and movement of the surface water were used to avoid air bubbles and to facilitate the release of the frozen ice. Freeston's apparatus of 1901, U.S. Pat. No. 672,036, illustrated another approach to ice making where the temperature of the tap water is reduced by passing it through a cooling tank first and then into a freezing or ice forming tank where the water was kept motionless during the freezing process. Liberation of air and gases from the water was accomplished by preheating the water prior to passage to the cooling tank. Surplus cool water from the freezing tank was periodically pumped back up to the cooling tank. Brine or ammonia was used as the freezing media.

Howe's apparatus of 1956, U.S. Pat. No. 2,775,100, is illustrative of ice makers wherein water which collects in the freezing tank is discharged at the end of each freezing cycle to prevent the concentration of minerals which might otherwise occur. As the water is discharged, it proceeds to a receiver where it is placed in a heat exchange relationship with the new water from the city supply which will ultimately enter the freezing tank. Bayston's 1960 apparatus, U.S. Pat. No. 2,949.752, is addressed to the making of ice cubes in great quantity by pairing freezing units back to back. The water is precooled by passing through an open topped reservoir before entering the dual freezing units where the water is frozen under conditions of continuous flow. Excess water from the freezing units is caught by the reservoir and thereby reenters the freezing cycle. Alt's ice maker of 1962, U.S. Pat. No. 3,021,686, also uses recirculation of the freezing water over the ice forming members to reduce the time of ice formation.

Cornelius's apparatus of 1972, U.S. Pat. No. 3,665,722, is addressed to controlling the degree of cooling of the liquid that takes place in coin operated cold drink dispensers. The amount of liquid dispensed is controlled by a timer. Larriva's refrigeration booster of 1973, U.S. Pat. No. 3,779,029, seeks to increase the thermal effectiveness of an ice maker by an auxiliary refrigeration unit cooling coil, plus two other coils containing refrigerants which cool the water on the way to the ice maker.

As can be seen, prior art devices to enhance icemaking have involved the recirculation of the water from reservoirs directly below the freezing units or involved auxiliary units containing refrigerants. The present invention offers savings beyond these improvements by utilizing the cooling energy from the residual ice water draining from storage bins and the cooling energy of the stored ice cubes awaiting use.

Prior art known to this inventor includes the following U.S. Patent Numbers:

| | | |
|---|---|---|
| 529,345 | 11/1894 | Church |
| 672,036 | 4/1901 | Freeston |
| 2,775,100 | 12/1956 | Howe |
| 2,949,752 | 8/1960 | Bayston |
| 3,021,686 | 2/1962 | Alt |
| 3,665,722 | 5/1972 | Cornelius |
| 3,779,029 | 12/1973 | Larriva |

BRIEF SUMMARY OF THE INVENTION

The present invention is an apparatus in kit form or for factory installation for cooling tap water fed to a conventional commercial ice cube maker having an ice cube making section, a storage bin with side walls and a drain for draining residual ice water from the interior of said storage bin.

According to the preferred embodiment of this invention, the operative components are a precooling means and a holding means. The precooling means, attached to the underside of the storage bin, is for precooling the tap water enroute from the tap water source to the ice making section of the commercial ice maker. The holding means is for temporarily storing and cooling the precooled tap water after passage of the tap water through the precooling means and prior to injection of the precooled tap water into the ice making section of the commercial ice cube maker.

Precooling means of the present invention is a reservoir attached to the underside of the storage bin so as to catch and store residual ice water draining from the storage bin, and precooling tubing, carrying the tap water from the tap water source to the ice making section of the commercial ice cube maker, coiled within the reservoir so as to be immersed in the residual ice water therein, and an overflow tube, attached to the reservoir, for removing excess residual ice water which may accumulate in the reservoir and for carrying the excess water to a sewer or other disposal area.

Holding means of the present invention is holding tubing inserted in the flow line from the precooling tubing to the ice making section and coiled in the lower interior section of the storage bin underneath the stored ice cubes therein.

Although the preferred embodiment of this invention includes both a precooling means and a holding means, there would be a factory installed version and a kit or retrofit version. The factory installed version would have both the precooling means and the holding means. The kit version would be available either with both the precooling means and holding means or with just the precooling means alone.

In the factory installed version of the apparatus the holding tubing passes inside the side walls of the storage bin enroute to the ice making section, the coils of the holding tubing being mounted permanently in the lower interior section of the storage bin underneath the stored ice cubes therein.

In the kit version of the apparatus of the present invention, the apparatus would usually be installed on site by adding the precooling means or both the precooling means and holding means to an existing commercial ice cube maker. In the simplest kit version, the apparatus for cooling tap water fed to a conventional commercial ice cube maker having an ice making section, a storage bin with side walls, and a drain for draining residual ice water from the interior of the storage bin, is solely a precooling means, attached to the underside of the storage bin for precooling the tap water enroute from the tap water source to the ice making section of the commercial ice cube maker.

The precooling means of this simplest kit version of the present invention is a reservoir attached to the underside of the storage bin so as to catch and store residual ice water draining from the storage bin via the drain, and precooling tubing, carrying the tap water from the tap water source to the ice making section of the commercial ice cube maker, coiled within the reservoir so as to be immersed in the residual ice water therein, and an overflow tube for removing excess residual ice water which may accumulate in the reservoir and for carrying the excess water to a sewer or other disposal area.

OBJECTIVES OF THE INVENTION

The objectives of the present invention are to provide improved precooling and storing apparatus for commercial ice cube makers, which will:

(1) speed up the ice making process;

(2) be more efficient by increasing ice cube production on the same or a reduced amount of electrical energy;

(3) improve the longevity of compressors by reducing the head pressure required to produce a given amount of ice cubes;

(4) enable the use of smaller compressors to achieve the same production of ice cubes;

(5) be more simple and inexpensive to manufacture than devices in the prior art designed to perform the same function;

(6) be easy to install and maintain either as a factory installed unit or in kit form for converting existing commercial ice cube makers at on site locations;

Other objectives and advantages of the present invention will be apparent during the course of the following detailed description.

DETAILED DESCRIPTION OF THE PREFERRED EMBODIMENT

Figure 1:
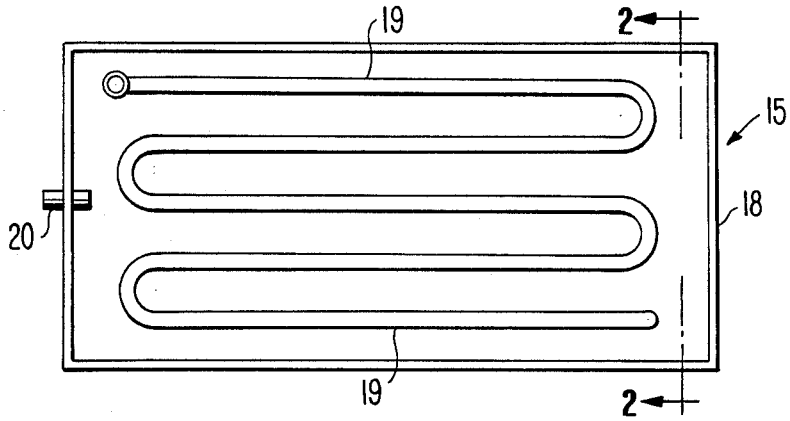
FIG. 1 is a plan view of the precooling means of an apparatus constructed in accordance with the principles of the present invention, showing the reservoir and the precooling tubing.
Figure 2:
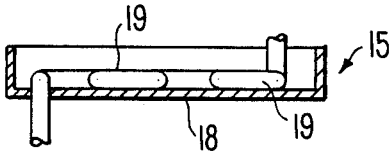
FIG. 2 is a sectional view of the same precooling means of the present invention, taken along the line 2—2 in FIG. 1 from the direction of the arrows, showing the position of the coiled precooling tubing within the reservoir.

The present invention is an apparatus for cooling tap water fed to a conventional commercial ice cube maker, shown generally at reference numeral 10. Such commercial ice makers 10, have an ice making section, shown generally at reference numeral 11, a storage bin, shown generally at reference numeral 12, with side walls 13 and a drain 14 for draining residual ice water from the interior of storage bin 12. Tap water in warmer climates, where the instant invention is most efficient, is usually found at a temperature of about 80 degrees Fahrenheit. In colder climates the apparatus would be less in demand as would ice cubes.

Figure 5:
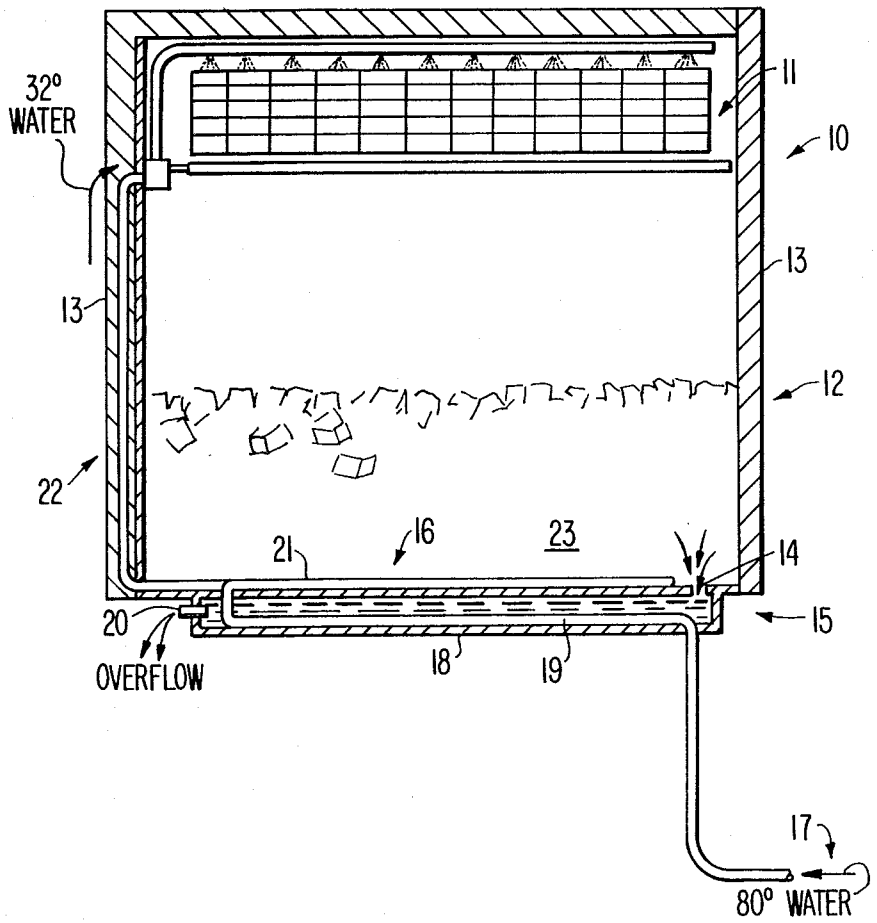
FIG. 5 is a perspective view of a commercial ice cube maker showing how the precooling means and holding means of the present invention are installed using the factory installed version of the present invention with the holding tubing passing inside the side walls of the storage bin.
Figure 4:
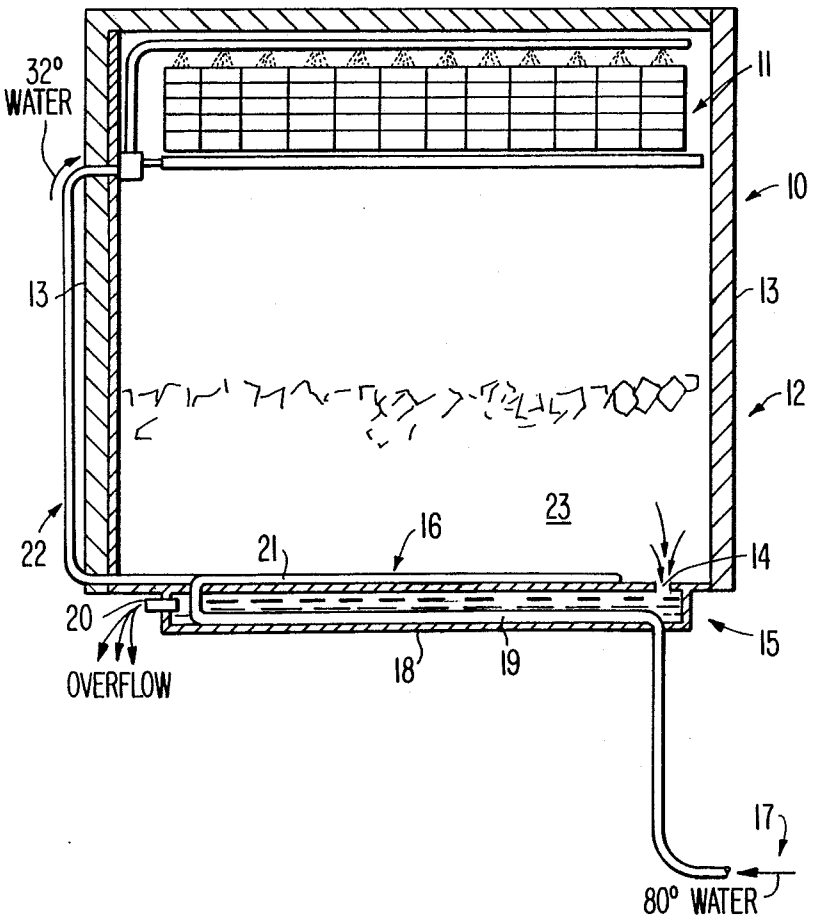
FIG. 4 is a perspective view of a commercial ice cube maker showing how the precooling means and the holding means of the apparatus of the present invention are installed using the kit or retrofit version of the present invention.

According to the preferred embodiment of the present invention, the operative components are a precooling means, shown generally at reference numeral 15 and a holding means, shown generally at reference numeral 16, of FIGS. 4 and 5. Precooling means 15, attached to the underside of storage bin 12, is for precooling the tap water enroute from the tap water source, shown generally at reference numeral 17, to ice making section 11 of commercial ice cube maker 10. Holding means 16 is for temporarily storing the precooled tap water after passage of the tap water through precooling means 15 into ice making section 11 of commercial ice cube maker 10.

Precooling means 15 of the present invention is a reservoir 18 attached to the underside of storage bin 12 so as to catch and store residual ice water draining from storage bin 12 via drain 14, and precooling tubing 19, carrying the tap water from tap water source 17 to ice making section 11 of commercial ice cube maker 10, coiled within reservoir 18 so as to be immersed in the residual ice water therein, and an overflow tube 20, attached to reservoir 18, for removing excess residual ice water which may accumulate in reservoir 18 and for carrying the excess water to a sewer or other disposal area (not shown).

Holding means 16 of the present invention is holding tubing 21, inserted in the flow line, shown generally at reference numeral 22, from precooling tubing 19 to ice making section 11 and coiled in the lower interior section, shown generally at reference numeral 23, of storage bin 12 underneath the stored ice cubes therein.

Preferably both precooling tubing 19 and holding tubing 21 would be made of copper tubing (food grade material), although other less efficient materials could be used. Precooling tubing 19 and holding tubing 21 are best coiled flat in a spaced relationship to avoid loss of cooling energy through conduction of the tubing surfaces. Reservoir 18 is a shallow tray made of stainless steel or plastic and would be attached to the underside of storage bin 12 by bolts or screws (not shown).

Although the preferred embodiment of the present invention includes both a precooling means 15 and a holding means 16, there would be a factory installed version and a kit or retrofit version. As shown in FIG. 5, the factory installed version would have both the precooling means 15 and the holding means 16. The kit version would be available either with both the precooling means 15 and the holding means 16, as shown in FIG. 4 or with just the precooling means 15 alone, as shown in FIG. 3.

As also shown in FIG. 5, in the factory installed version of the apparatus of the present invention, holding tubing 21 passes inside side walls 13 of storage bin 12 enroute to ice making section 11, the coils of holding tubing 21 being mounted permanently in the lower interior section 23 of storage bin 12 underneath the stored ice cubes therein.

Figure 3:
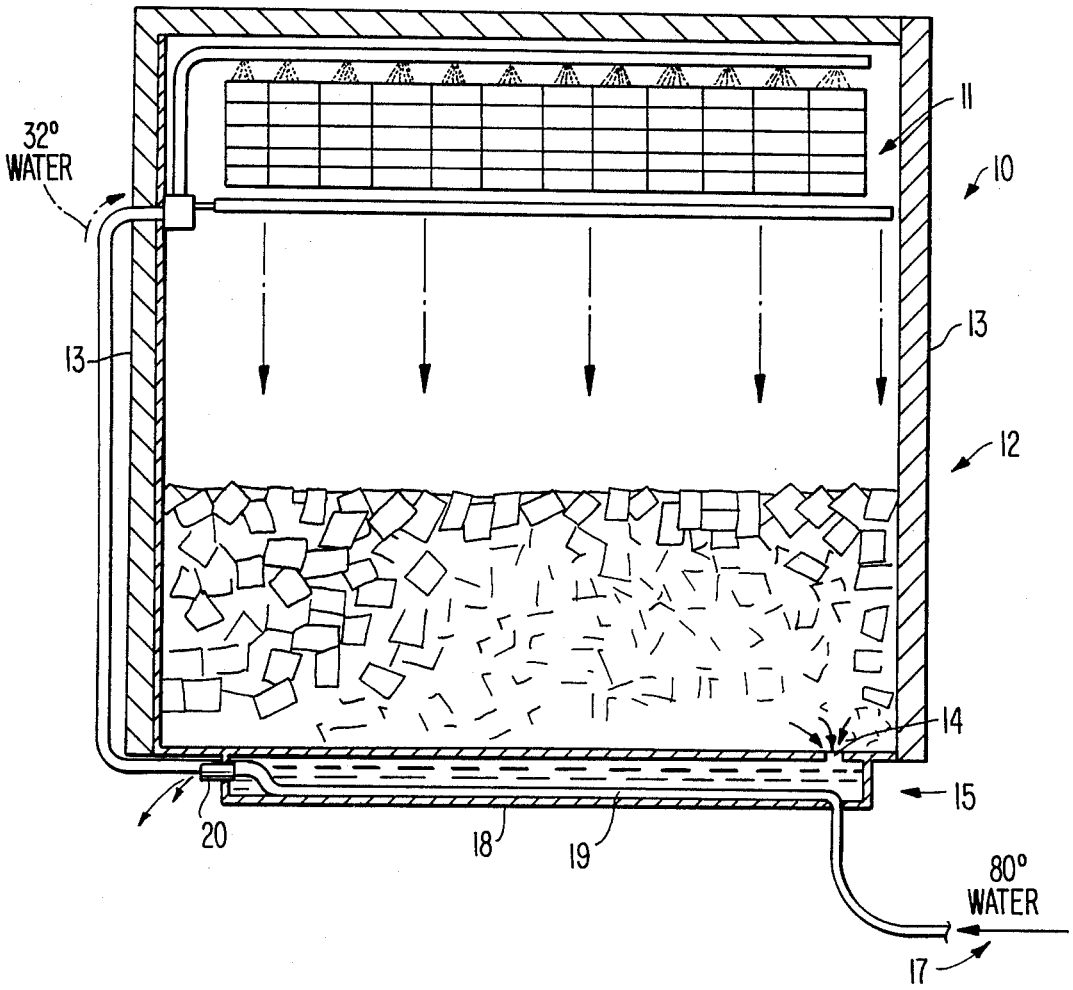
FIG. 3 is a perspective view of the same precooling means of the present invention, showing how the reservoir and precooling tubing are attached to a commercial ice cube maker.

In the kit version of the apparatus of the present invention, the apparatus would usually be installed on site by adding precooling means 15 (as shown in FIG. 3) or both precooling means 15 and holding means 16 (as shown in FIG. 4) to an existing commercial ice cube maker 10. In the simplest kit version, the apparatus of the present invention for cooling tap water fed to a conventional commercial ice maker 10 having an ice making section 11, a storage bin 12 with side walls 13 and a drain 14 for draining residual ice water from the interior of storage bin 12, is solely a precooling means 15, attached to the underside of storage bin 12, for precooling the tap water enroute from tap water source 17 to the ice making section 11 of commercial ice cube maker 10.

As shown in FIG. 3, precooling means 15 of this simplest kit version of the present invention is a reservoir 18, attached to the underside of storage bin 12 so as to catch and store residual ice water draining from storage bin 12, and precooling tubing 19, carrying the tap water from tap water source 17 to ice making section 11 of the commercial ice cube maker 10, coiled within reservoir 18 so as to be immersed in the residual ice water therein, and an overflow tube 20, attached to reservoir 18, for removing excess residual ice water which may accumulate in reservoir 18 and for carrying the excess water to a sewer or other disposal area (not shown).

I claim:

1. An apparatus, in kit form or for factory installation, for cooling tap water fed to a conventional commercial ice cube maker having an ice cube making section, a storage bin with side walls and a drain for draining residual ice water from the interior of said storage bin, comprising:

a reservoir attached to the underside of said storage bin so as to catch and store residual ice water draining from said storage bin via said drain, and precooling tubing, carrying said tap water from the tap water source to the ice making section of said commercial ice cube maker, coiled within said reservoir so as to be immersed in said residual ice water therein, and an overflow tube, attached to said reservoir, for removing excess residual ice water which may accumulate in said reservoir and for carrying said excess water to a sewer or other disposal area, and holding tubing, for temporarily storing and cooling the precooled tap water, inserted in the flow line from said precooling tubing to said ice making section and coiled in the lower interior section of said storage bin underneath the stored ice cubes therein.

2. The apparatus of claim 1 wherein said holding tubing passes inside the side walls of said storage bin enroute to said ice making section, the coils of said holding tubing being mounted permanently in the lower interior section of said storage bin underneath the stored ice cubes therein.

* * * * *